US006312241B1

(12) United States Patent
Kamamoto et al.

(10) Patent No.: US 6,312,241 B1
(45) Date of Patent: Nov. 6, 2001

(54) GEAR PUMP

(75) Inventors: Shigeo Kamamoto; Wataru Yamada, both of Kashiwara; Takayasu Yamazaki, Tenri, all of (JP)

(73) Assignee: Koyo Seiko Co., Ltd., Osaka (JP)

( * ) Notice: Subject to any disclaimer, the term of this patent is extended or adjusted under 35 U.S.C. 154(b) by 0 days.

(21) Appl. No.: 09/639,937

(22) Filed: Aug. 17, 2000

(30) Foreign Application Priority Data

Sep. 6, 1999 (JP) ..... 11-251892

(51) Int. Cl.[7] ..... F01C 21/00
(52) U.S. Cl. ..... 418/189; 418/206.4
(58) Field of Search ..... 418/206.4, 189

(56) References Cited

U.S. PATENT DOCUMENTS

| | | | | |
|---|---|---|---|---|
| 2,310,078 | * | 2/1943 | Herman | 418/178 |
| 2,714,856 | * | 8/1955 | Kane | 418/206.6 |
| 3,303,792 | * | 2/1967 | Littlewood | 418/189 |
| 3,713,759 | * | 1/1973 | Pollman et al. | 418/74 |
| 3,817,665 | * | 6/1974 | Myers | 418/189 |
| 4,017,224 | * | 4/1977 | Jons | 418/189 |
| 4,087,216 | * | 5/1978 | Shumate | 418/74 |
| 4,130,383 | * | 12/1978 | Moinuddin | 418/189 |
| 4,231,726 | * | 11/1980 | Cobb et al. | 418/74 |
| 4,239,468 | * | 12/1980 | Smith | 418/132 |
| 4,290,739 | * | 9/1981 | Korse | 418/189 |
| 4,311,444 | * | 1/1982 | Shumate | 418/74 |
| 4,336,005 | * | 6/1982 | McBurnett et al. | 418/74 |
| 4,368,013 | * | 1/1983 | Toogood | 418/74 |
| 5,118,268 | * | 6/1992 | Crisenbery et al. | 418/189 |
| 5,131,829 | * | 7/1992 | Hampton | 418/189 |
| 5,730,589 | * | 3/1998 | Rausch et al. | 418/74 |

FOREIGN PATENT DOCUMENTS

| | | | | |
|---|---|---|---|---|
| 2610138-A | * | 9/1977 | (DE) | 418/189 |
| 4217160-A | * | 11/1993 | (DE) | 418/189 |
| 977730-A | * | 4/1951 | (FR) | 418/189 |
| 9-256966 | | 9/1997 | (JP) . | |
| 2016243-A | * | 7/1994 | (RU) | 418/189 |
| 1211457-A | * | 2/1986 | (SU) | 418/189 |

* cited by examiner

*Primary Examiner*—Thomas Denion
*Assistant Examiner*—Theresa Trieu
(74) *Attorney, Agent, or Firm*—Rabin & Berdo, P.C.

(57) ABSTRACT

A gear pump includes a pair of gears accommodated in a gear chamber. When the inside pressure of a trap region which is changed with the rotation of the gears becomes substantially equal to the inside pressure of an inlet chamber, the communication state is switched from a state in which communication between the trap region and the first and second relief channels is blocked to a state in which the trap region communicates with the second relief channel. With the inside pressure of the trap region being substantially equal to the inside pressure of the inlet chamber, the trap region is opened to the inlet chamber.

5 Claims, 5 Drawing Sheets

GEAR PUMP

CROSS REFERENCE TO RELATED APPLICATION

This application claims priority benefits under 35 USC §119 on the basis of Japanese Patent Application No. 11-251892 (1999), the disclosure thereof being incorporated herein by reference.

BACKGROUND OF THE INVENTION

1. Field of the Invention

The present invention relates to a gear pump which provides a pumping effect by rotation of a pair of gears meshing with each other.

2. Description of Related Arts

Gear pumps which are compact and lightweight with simple constructions are conventionally employed in various industrial fields.

In general, such a gear pump has a gear chamber defined between a pair of side plates fitted in a cavity within a housing. A pair of gears meshing with each other are accommodated in the gear chamber. Support shafts of the gears are respectively supported with opposite ends thereof being fitted in support holes formed in the respective side plates. An operating fluid inlet chamber and an operating fluid outlet chamber are respectively provided on opposite sides of a meshing position of the gears in the gear chamber.

In the gear pump, a so-called trapping phenomenon occurs in the vicinity of the gear meshing position, that is, an operating oil is trapped in a region defined between the respective side plates and the gears meshing with each other. When the operating oil trapped in the aforesaid region is compressed by the rotation of the gears, an extraordinarily high pressure is developed in that region, resulting in vibrations and noises.

One approach to this problem is to form relief channels in the side plates adjacent the gear meshing position for releasing the oil trapped in the trap region. The relief channels are provided in pair and include a high pressure side relief channel extending from the vicinity of the gear meshing position to the outlet chamber and a low pressure side relief channel extending from the vicinity of the gear meshing position to the inlet chamber. The pair of relief channels communicate with the trap region in the vicinity of the gear meshing position. The high pressure side relief channel releases the oil trapped in the trap region into the outlet chamber, while the low pressure side relief channel releases the oil trapped in the trap region into the inlet chamber. For prevention of the trapping phenomenon, either of the relief channels should communicate with the trap region at all times.

In order to ensure the pumping effect of the gear pump, on the other hand, communication between the inlet chamber and the outlet chamber should be prevented. Therefore, the pair of relief channels should be prevented from directly communicating with each other and from simultaneously communicating with the trap region. In this respect, the trap region is first brought into communication with the high pressure side relief channel, and then brought into communication with the low pressure side relief channel with the communication with the high pressure side relief channel being blocked, when the meshing of the gears is progressed by the rotation of the gears.

Immediately before the communication with the low pressure side relief channel, the trap region communicates with the high pressure side relief channel and, therefore, has a high inside pressure which is equal to the inside pressure of the outlet chamber. When the trap region communicating with the high pressure side relief channel under the high pressure is instantaneously brought into communication with the low pressure side relief channel, the high pressure trap region communicates with the inlet chamber under a low pressure through the low pressure side relief channel. As a result, the high pressure oil is released into the low pressure inlet chamber, so that impactive noises and vibrations are generated.

SUMMARY OF THE INVENTION

In order to solve the aforesaid problem, it is an object of the present invention to provide a gear pump which can assuredly prevent the vibrations and the noises which may otherwise occur due to the trapping phenomenon.

In accordance with a preferred mode of the present invention, there is provided a gear pump which includes a pair of gears accommodated in a gear chamber and has a trap region developed in the vicinity of a meshing position of the pair of gears during rotation of the pair of gears, the gear pump comprising: an operating fluid inlet chamber and an operating fluid outlet chamber disposed on opposite sides of the meshing position within the gear chamber; a first relief channel for providing communication between the trap region and the outlet chamber; and a second relief channel for providing communication between the trap region and the inlet chamber. As the pair of gears are rotated, a communication state is sequentially switched among a first state in which the trap region communicates only with the first relief channel, a second state in which communication between the trap region and the first and second relief channels is blocked, and a third state in which the trap region communicates only with the second relief channel. When the inside pressure of the trap region is reduced to a level substantially equal to the inside pressure of the inlet chamber in the second state during the rotation of the pair of gears, the communication state is switched to the third state.

According to this mode, the pressure of the operating fluid in the trap region is gradually reduced as the volume of the trap region is gradually increased in the second state. When the inside pressure of the trap region becomes substantially equal to the inside pressure of the inlet chamber, the communication state is switched to the third state, whereby the trap region is opened to the inlet chamber. Therefore, no impact is generated when the trap region is opened to the inlet chamber, so that the noises and the vibrations can be prevented.

It is preferred that the communication state is switched to the second state when the volume of the trap region is minimized in the first state during the rotation of the pair of gear.

In this case, the switching from the first state to the second state occurs when the trap region has the minimum volume. Therefore, an increase in the volume of the trap region can be enhanced in the second state, so that a reduction in the pressure can be enhanced in the second state. Thus, the inside pressure of the trap region can sufficiently be reduced to be made closer to the inside pressure of the inlet chamber before the trap region is brought into communication with the second relief channel, whereby the vibrations and the noises can assuredly be prevented.

DETAILED DESCRIPTION OF THE PREFERRED EMBODIMENT

A gear pump according to one embodiment of the present invention will hereinafter be described with reference to the attached drawings.

Figure 1:
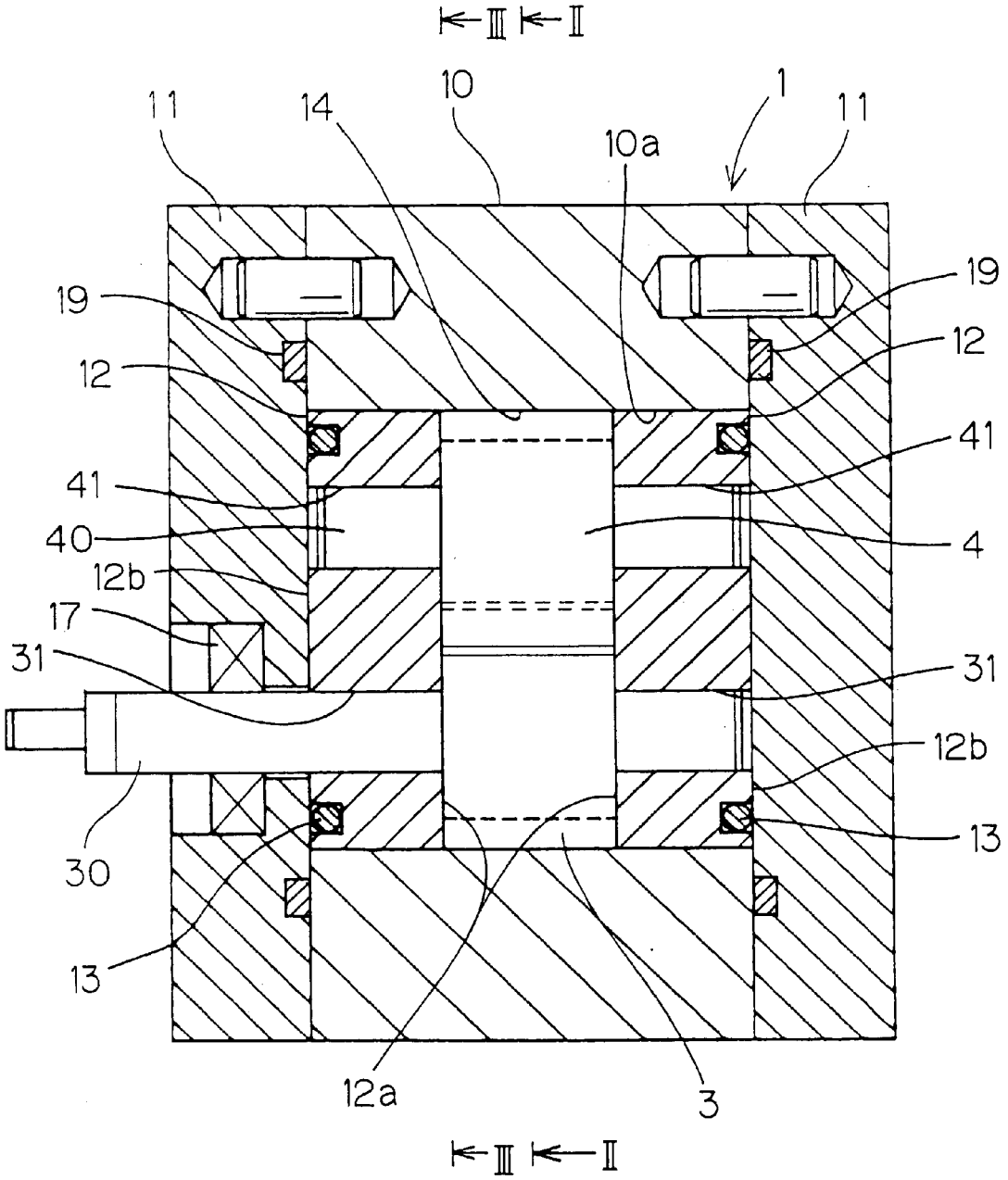
FIG. 1 is a sectional view of a gear pump according to one embodiment of the present invention.
Figure 2:
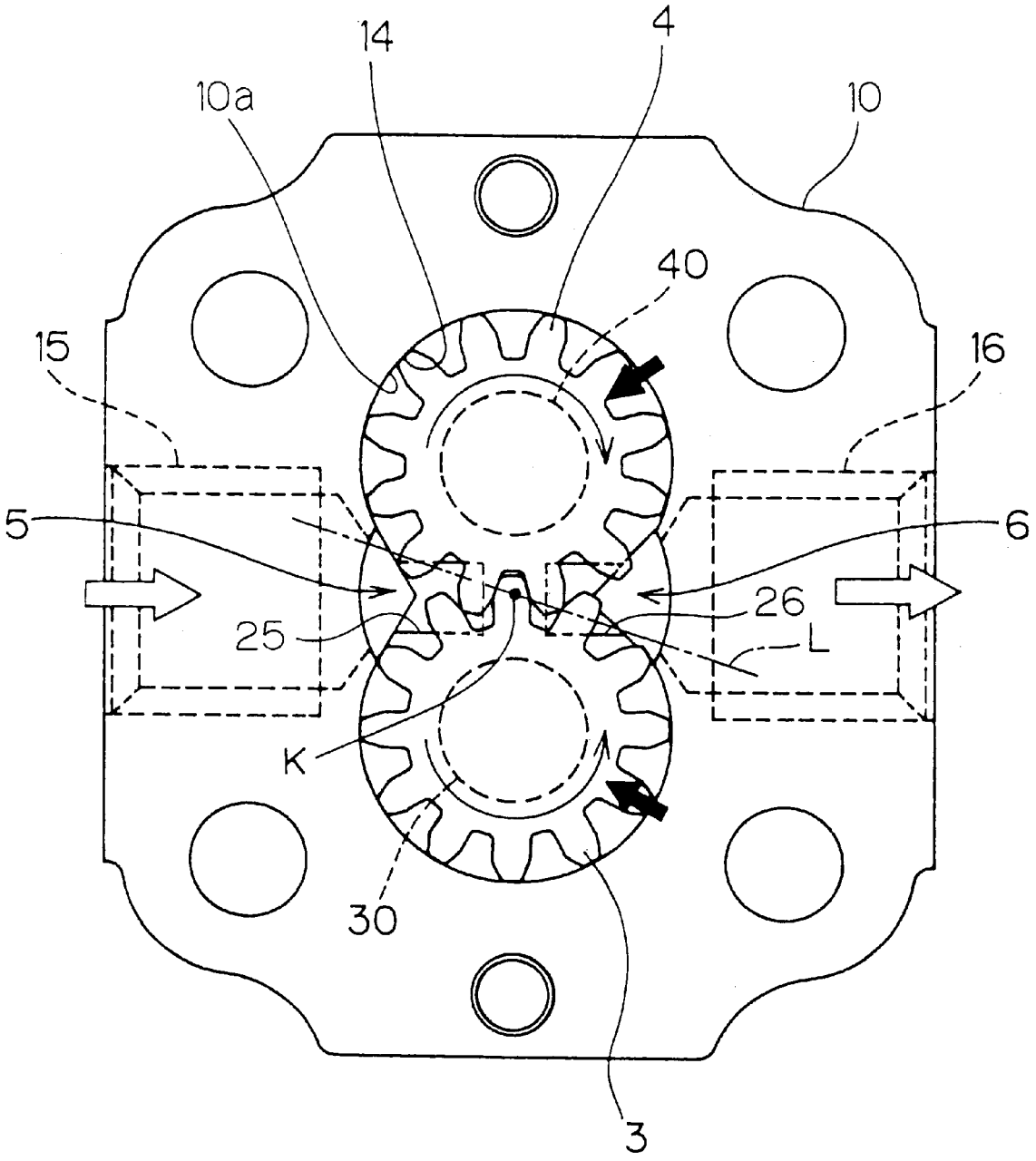
FIG. 2 is a sectional view taken along a line II-II in FIG. 1 in which a hatching is omitted.

Referring to FIGS. 1 and 2, the gear pump has a housing 1 including a cylindrical body 10 which has a cavity extending centrally thereof and having a generally elliptical cross section with opposite ends thereof closed by a pair of cover plates 11 fixed thereto by screws. A pair of side plates 12 such as of an aluminum alloy are inserted in the cavity of the housing 1 from opposite sides of the cavity to define a gear chamber 14 therebetween. A driving gear 3 and a driven gear 4 are accommodated in pair in the gear chamber 14.

A reference numeral 13 denotes seals respectively provided between the cover plates 11 and the corresponding side plates 12 for sealing the gear chamber 14. A reference character 19 denotes seals respectively provided between the cover plates 11 and the cylindrical body 10 for sealing the cavity 10*a* of the housing 1.

A pair of support shafts 30, 40 are supported within the gear chamber 14 with opposite ends thereof being fitted in pairs of support holes 31, 41 formed in the side plates 12. The support shafts 30, 40 are located parallel to each other along axes of semicircular opposite side portions of the gear chamber 14 having an elliptical cross section.

One of the support shafts 30 supported in the pair of support holes 31 extends through one of the cover plates 11 to the outside, serving as a driving shaft to be rotatively driven by a drive force applied through an extension of the shaft from a power source such as a motor not shown. The driving gear 3 is fitted around the support shaft 30 in a corotatable manner within the gear chamber 14. An oil seal 17 is provided around the support shaft 30 in the cover plate 11.

The other support shaft 40 supported by the pair of support holes 41 serves as a driven shaft having opposite ends fitted in the support holes 41 of the respective side plates 12. The driven gear 4 is fitted around the support shaft 40 within the gear chamber 14. The driven gear 4 may be nonrotatable or rotatable about the support shaft 40. The driven gear 4 meshes with the driving gear 3 within a plane including the axes of the support shafts 30, 40 thereby to be driven for corotation with the support shaft 40 (or for rotation independent of the support shaft 40) by the rotation of the driving gear 3 driven through the support shaft 30.

In FIG. 2, the direction of the rotation of the driving gear 3 and the direction of the rotation of the driven gear 4 interlocked with the driving gear 3 are indicated by arrows. An inlet chamber 5 and an outlet chamber 6 are provided on opposite sides of a meshing position of the gears 3, 4, i.e., on a forward side and a rearward side with respect to the rotation directions. The inlet chamber 5 and the outlet chamber 6 are respectively connected to a suction portion and a discharge portion (not shown) outside the housing 1 via an inlet 15 and an outlet 16 which open into corresponding portions of the cylindrical body 10. A reference character L denotes an action line of the meshing of the pair of gears 3, 4.

With this arrangement, an operating fluid introduced into the inlet chamber 5 via the inlet 15 is received between teeth of the driving gear 3 and the driven gear 4 facing the inlet chamber 5, and confined in inter-teeth spaces defined by the teeth of the gears and the interior surface of the cylindrical body 10 thereby to be delivered into the outlet chamber 6. The teeth of the driving gear 3 and the driven gear 4 involved in the delivery of the operating fluid to the outlet chamber 6 are moved through the meshing position of the gears 3, 4 and then face the inlet chamber 5, whereby the operating fluid is received between the teeth of the gears again for the delivery of the operating fluid to the outlet chamber 6.

During the operation thus performed by the gear pump, there is a pressure distribution which ranges from a low pressure in the inlet chamber 5 to a high pressure in the outlet chamber 6 with a pressure increase occurring in the gear chamber 14 by the rotation of the driving gear 3 and the driven gear 4. Therefore, pressing forces are exerted on the driving gear 3 and the driven gear 4 in the directions of black solid arrows in FIG. 2.

There would be a possibility that the operating fluid is trapped between a tooth tip of one of the gears and an inter-teeth portion of the other gear at the meshing position of the driving gear 3 and the driven gear 4, whereby an extraordinarily high pressure is developed to cause vibrations and noises.

Figure 3:
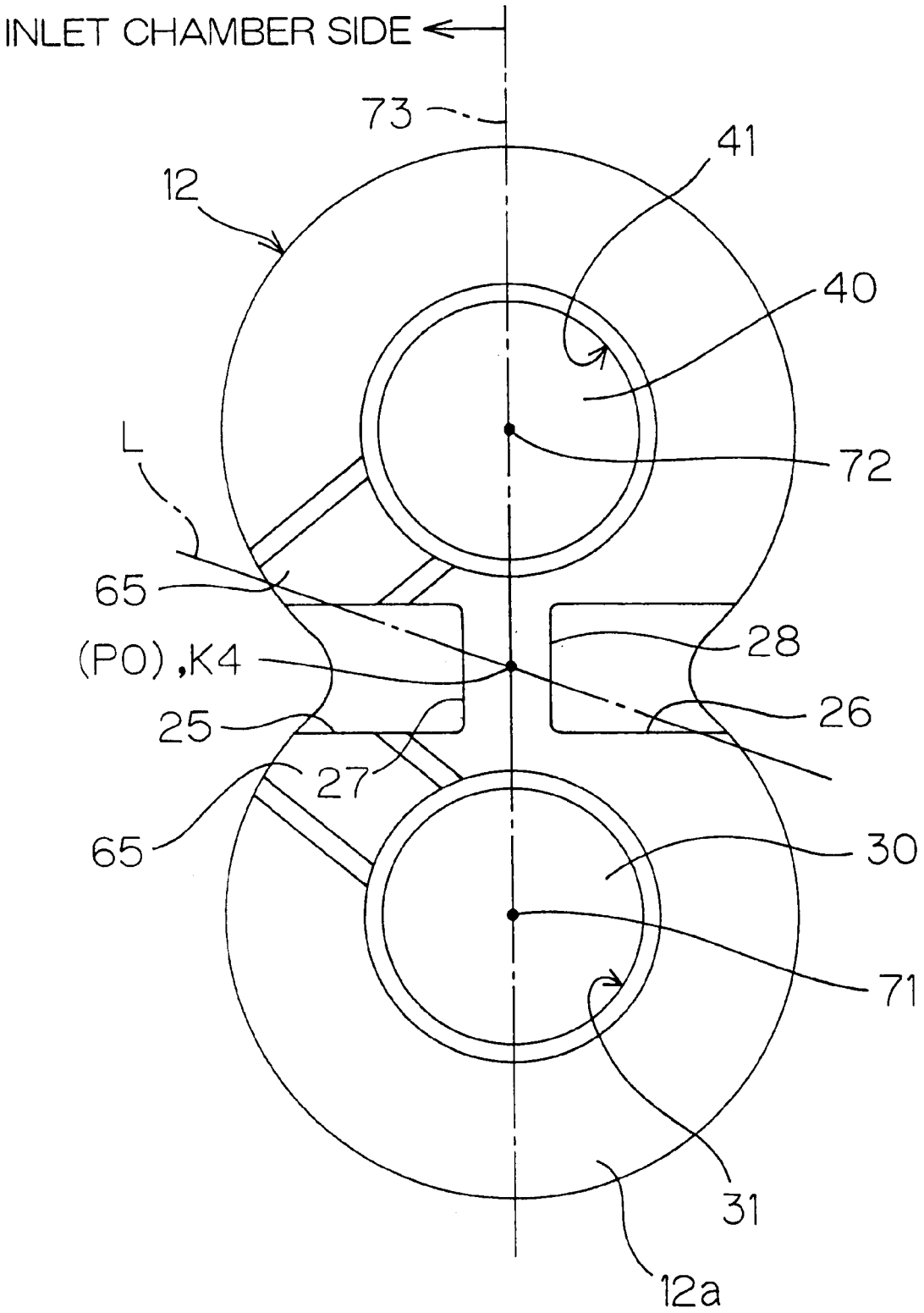
FIG. 3 is a side view of a side plate taken along a line III—III in FIG. 1.

In this embodiment, however, relief channels 25 and 26 are provided in a side face 12*a* of the side plate 12 adjacent to the gears as extending from the meshing position of the gears 3, 4 to the inlet chamber 5 and the outlet chamber 6, respectively, as shown in FIG. 3. The relief channels 25, 26 prevent the so-called trapping phenomenon, i.e., prevent the operating fluid from being trapped in a trap region defined by the respective side plates 12 and gear teeth meshing with each other in the meshing position of the gears 3, 4. The relief channels 25, 26 are provided in a predetermined spaced relation away from the meshing center of the gears 3, 4. This prevents communication between the relief channels 25 and 26 which would cause the inlet chamber 5 and the outlet chamber 6 to communicate with each other thereby to make it impossible to provide the pumping effect. Communication channels 65 are provided in the side face 12*a* adjacent to the gears for communication between the support holes 31, 41 and the inlet chamber 5.

Referring again to FIG. 1, spaces defined between side faces 12*b* of the side plates 12 opposite from the gears and the cover plates 11 respectively opposed to the side faces 12*b* are each divided by the seals 13 into a low pressure space communicating with the inlet chamber and a high pressure space communicating with the outlet chamber 6. With the spaces thus divided by the seals 13, the low pressure operating fluid and the high pressure operating fluid act to exert a back pressure on the side faces 12*b* of the side plates 12 opposite from the gears to apply loads on the side plates 12 in accordance with a discharge pressure, so that the respective gears 3, 4 and the side plates 12 are maintained in a properly spaced relation at a higher level of accuracy. As a result, the pumping efficiency can be maintained at a higher level during a high pressure pumping operation.

In this embodiment, the relief channels 25, 26 are configured so as to more assuredly prevent the trapping phenomenon.

An explanation will next be given to the trap region. The trap region is a region 50 defined by the pair of side plates 12, an inter-teeth bottom surface of one of the gears 3, 4 and a tooth tip of the other gear between two meshing points of adjacent teeth meshing with each other.

Figure 4A:
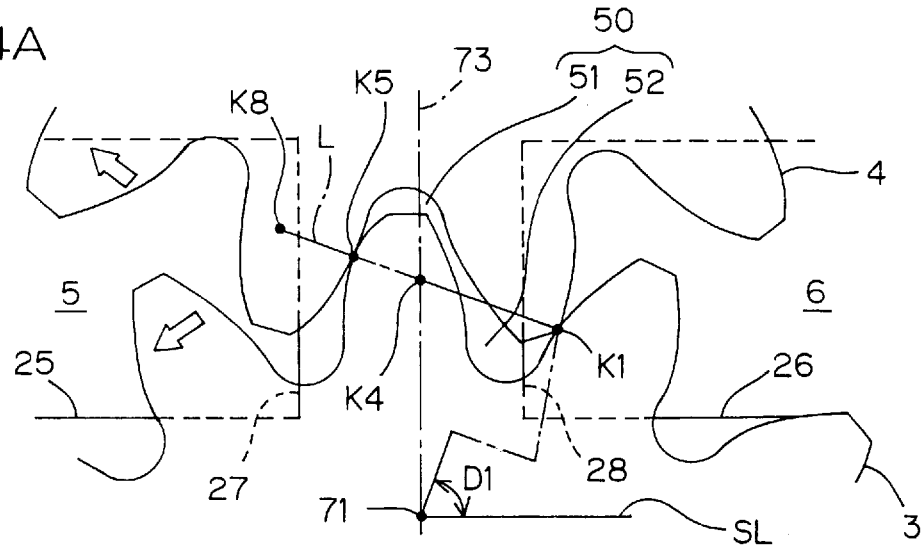
FIGS. 4A, 4B and 4C are enlarged side views illustrating major portions of the side plate for explanation of meshing between a driving gear and a driven gear.

For example, the trap region 50 is present between a pair of meshing points K1 and K5 of teeth simultaneously meshing with each other as shown in FIG. 4A. The trap region 50 includes a first region 51 located on a forward side with respect to the gear teeth advancing direction and a second region 52 located rearwardly of the first region 51 with respect to the advancing direction. The second region 52 is defined between the inter-teeth bottom surface of the driving gear 3 and the tooth tip of the driven gear 4. The first region 51 is defined between the tooth tip of the driving gear 3 and the inter-teeth bottom surface of the driven gear 4. In general, a gap or a backlash is formed between the first region 51 and the second region 52, permitting communication therebetween.

Figure 4B:
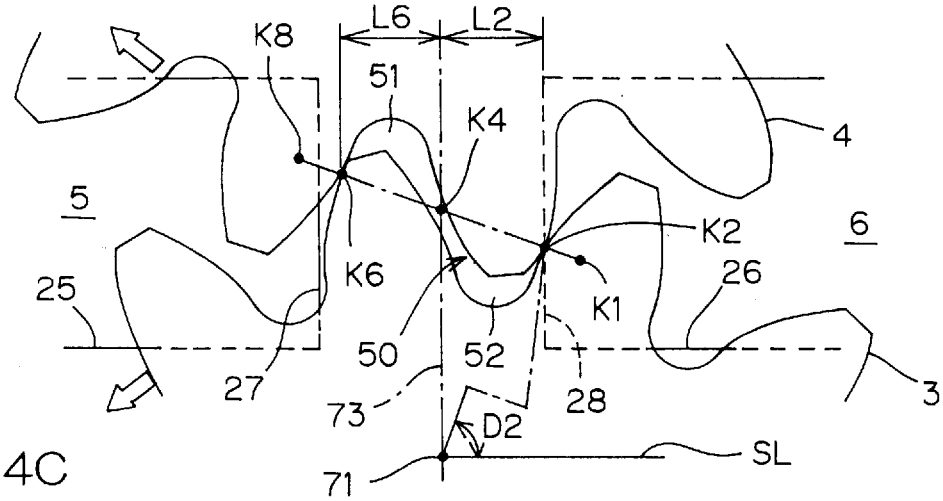
Figure 4C:
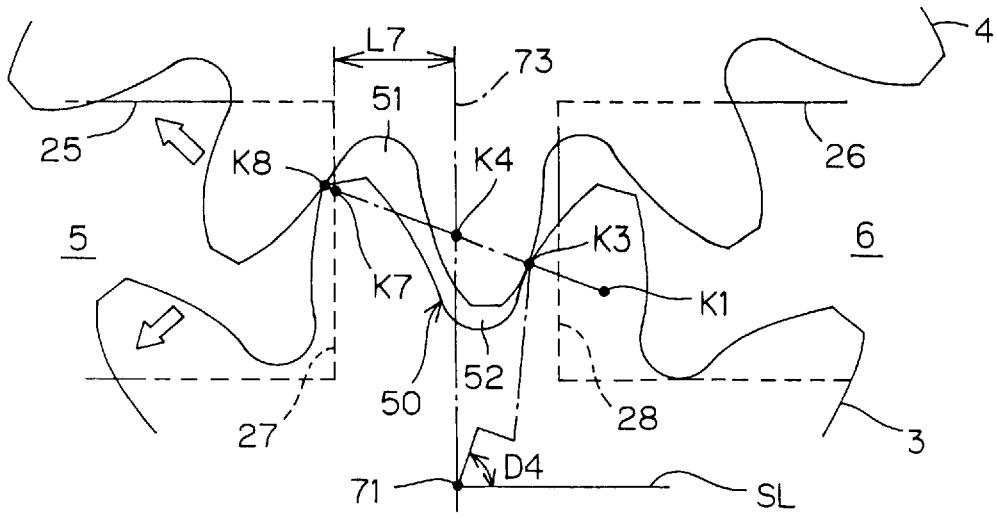

As the gears 3, 4 are rotated, a meshing point of the pair of gear teeth moves from a point K1 to a point K8, and the locus of the meshing point serves as the action line L as shown in FIGS. 4A, 4B and 4C. Referring to FIG. 3, the action line L extends through a pitch point P0 as seen axially of the support shaft 30. The action line L is inclined at an angle corresponding to a pressure angle of the gear teeth with respect to the gear teeth advancing direction at the pitch point P0 (corresponding to a point K4). During the movement of the meshing point from the point K1 to the point K8, the number of meshing points at which the gear teeth simultaneously mesh with each other changes. In a range between the points K1 and K3 and in a range between the points K5 and K8, two meshing points are present. In a range between the points K3 and K5, only one meshing point is present.

During the movement of the meshing point from the point K1 to the point K3, the trap region 50 moves in the gear teeth advancing direction, and the volume thereof changes. At a certain point between the points K1 and K3, the volume of the trap region is minimized. When the meshing point moves from the point K5 to the point K8, the same situation occurs.

Where only one meshing point is present between the points K3 and K5, the region defined between the inter-teeth bottom surface of the one gear and the tooth tip of the other gear communicates with the outlet chamber 6 or the inlet chamber 5 on either of opposite sides of the meshing point.

An explanation will next be given to the relief channels 25, 26. The relief channels 25, 26 are located on opposite sides of a line 73 that links the rotation centers 71 and 72 of the respective gears 3, 4. The relief channel 25 is located on the side of the inlet chamber 5, while the relief channel 26 is located on the side of the outlet chamber 6.

The relief channels 25, 26 each have a generally rectangular shape as seen axially of the support shaft 30 and have a predetermined depth. Edges 27, 28 of the relief channels 25, 26 adjacent to the line 73 are linear and parallel to the line 73.

The relief channel 25 allows for communication between the trap region 50 and the inlet chamber 5, while the relief channel 26 allows for communication between the trap region 50 and the outlet chamber 6. However, the relief channels 25, 26 are prevented from simultaneously communicating with the trap region 50. This prevents the inlet chamber 5 and the outlet chamber 6 from communicating with each other via the trap region 50 and the respective relief channels 25, 26.

As the gears 3, 4 are rotated, a communication state is sequentially switched among a first state in which the trap region 50 communicates only with the high pressure side relief channel 26, a second state in which the trap region 50 communicates neither with the high pressure side relief channel 26 nor with the low pressure side relief channel 25, and a third state in which the trap region 50 communicates only with the low pressure side relief channel 25.

The high pressure side relief channel 26 is located in a position which permits the trap region 50 to be brought out of communication with the outlet chamber 6 as a discharge region for switching the communication state to the second state when the volume of the trap region 50 which is changed by the rotation of the gears 3, 4 is minimized in the first state. More specifically, this situation occurs when the two meshing points of the gear teeth simultaneously meshing with each other are respectively located at points K2 and K6 as shown in FIG. 4B and a distance L2 between the point K2 and the line 73 (or the point K4) equals a distance L6 between the point K6 and the line 73 (or the point K4) as seen axially of the support shaft 30. At this time, the edge 28 of the relief channel 26 is located at the point K2 adjacent to the outlet chamber 6. When the meshing points are respectively located at the points K2 and K6 with the distance L2 being equal to the distance L6, the trap region 50 has the minimum volume and there is no overlap between the trap region 50 and the relief channel 26 as seen axially of the support shaft 30.

The low pressure side relief channel 25 is located in a position which permits the trap region 50 to be brought into communication with the inlet chamber 5 for switching the communication state to the third state when the inside pressure of the trap region 50 which is changed by the rotation of the gears 3, 4 becomes substantially equal to the inside pressure of the inlet chamber 5 as a suction region in the second state. More specifically, this situation occurs when the meshing point is moved from the point K6 to the point K7 with the progress of the meshing of the gears 3, 4 and a distance L7 between the point K7 and the line 73 (or the point K4) is greater than the distance L6 between the point K6 and the line 73 (or the point K4) as seen axially of the support shaft 30. At this time, the edge 27 of the relief channel 25 is located at the point K7 adjacent to the inlet chamber 5. There is no overlap between the trap region 50 and the relief channel 25 as seen axially of the support shaft 30 and, when the meshing point moves even slightly from the point K7 toward the point K8, the relief channel 25 is brought into communication with the trap region 50.

As the meshing point moves from the point K6 to the point K7, the volume of the trap region 50 is increased, so that the pressure of the operating fluid therein is reduced. When the meshing point reaches the point K7, the inside pressure of the trap region is substantially equal to the inside pressure of the inlet chamber 5.

The aforesaid point K7 is determined in the following manner. There is a known relationship such as represented by the Dowson-Higginson equation between the pressure and density of an operating fluid when the volume of a space in which the operating fluid is trapped is changed. By utilizing this relationship, the meshing point K7 can be determined at which the inside pressure of the trap region is substantially equal to the inside pressure of the inlet chamber 5. More specifically, the inside pressure of the trap region is reduced from a level equal to the inside pressure of the outlet chamber 6 to a level equal to the inside pressure of the inlet chamber 5 during the movement of the meshing point from the point K6 to the point K7. That is, the inside pressure of the trap region is reduced by a difference in inside pressure between the outlet chamber 6 and the inlet chamber 5. Therefore, the point K7 is determined in accordance with the point K6 of the meshing point by determining the amount of a change in the volume of the trap region required for the pressure reduction.

The operation of the gear pump will next be explained.

Figure 5:
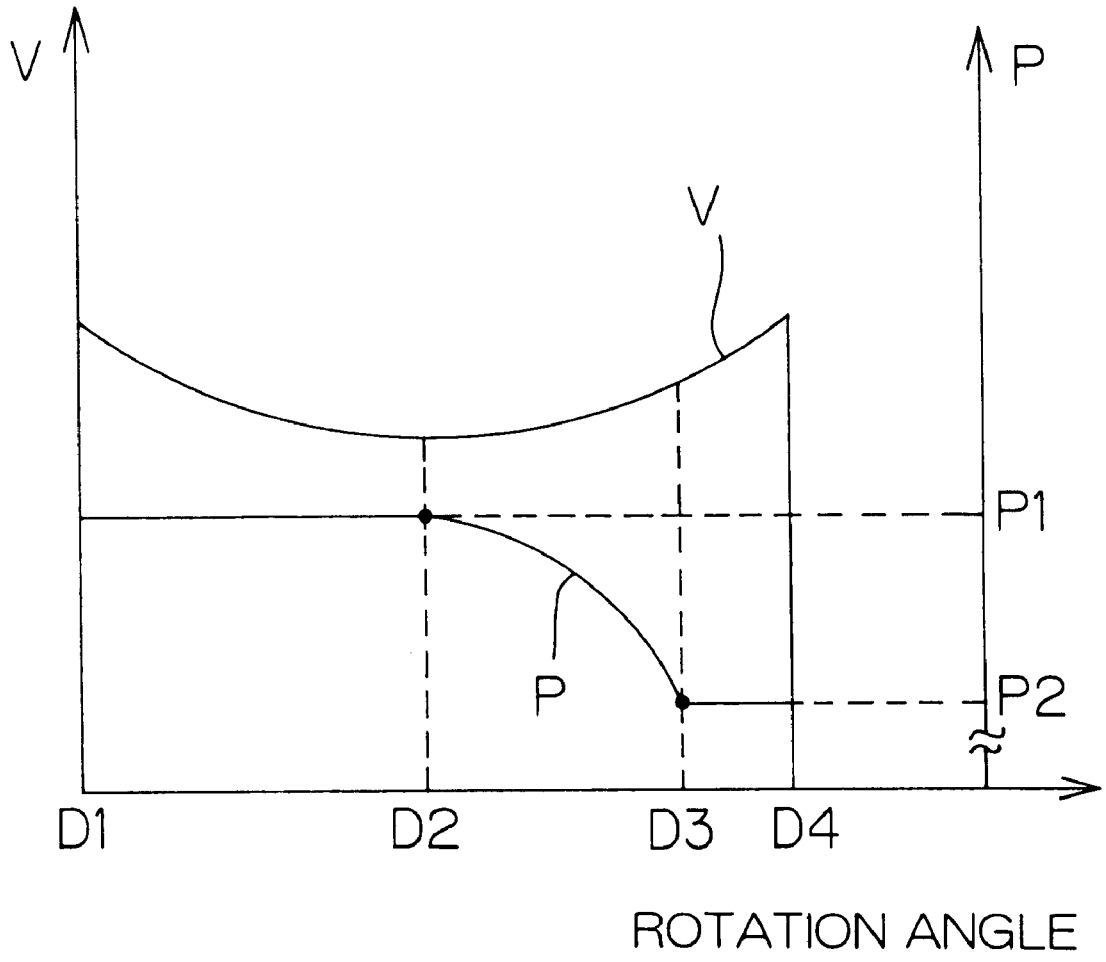
FIG. 5 is a graph illustrating changes in the volume of a trap region and the pressure of an operating fluid with a progress in gear meshing, in which the gear rotation angle is plotted as abscissa and the pressure and the volume are plotted as ordinate.

FIGS. 4A, 4B and 4C are enlarged side views of the side plate for explanation of the meshing of the driving gear and the driven gear. FIG. 5 is a graph illustrating changes in the pressure P of the operating fluid in the trap region and the volume V of the trap region with respect to the rotation angle of the gears, in which the rotation angle is plotted as abscissa and the pressure P and the volume V are plotted as ordinate. The rotation angle is represented by angles D1, D2, D3 and D4 which are formed between a reference line SL extending through the center 71 of the shaft 30 perpendicularly to the line 73 and a line extending from the meshing point adjacent to the outlet chamber to the center 71 of the shaft 30.

When the meshing point on the side of the outlet chamber 6 is located at the point K1 (corresponding to a point where the rotation angle is D1) as shown in FIG. 4A during the rotation of the pair of gears 3, 4, the meshing point on the side of the inlet chamber 5 is located at the point K5, so that the trap region 50 is formed.

While one of the meshing points moves from the point K1 to the point K2 (from the state shown in FIG. 4A to the state shown in FIG. 4B) by the progress of the meshing, the volume of the trap region 50 is gradually reduced. During this period, the trap region 50 communicates only with the outlet chamber 6 via the relief channel 26 (in the first state), so that the inside pressure of the trap region is equal to the inside pressure (P1 in FIG. 5) of the outlet chamber 6. Further, the communication between the trap region 50 and the inlet chamber 5 is blocked by the meshing point on the side of the inlet chamber 5.

When the one meshing point reaches the point K2 (corresponding to a position at the rotation angle D2) as shown in FIG. 4B, the other meshing point reaches the point K6, so that the volume of the trap region 50 is minimized. The communication between the trap region 50 and the relief channel 26 is blocked. Therefore, the trap region 50 communicates neither with the relief channel 25 nor with the relief channel 26 thereby to be brought out of communication with the outlet chamber 6 and the inlet chamber 5 (i n the second state).

In the transit from the state shown in FIG. 4B to the state shown in FIG. 4C, the volume of the trap region 50 is gradually increased by the rotation of the gears 3, 4 in the second state, so that the pressure of the operating fluid in the trap region is reduced. Just before the state shown in FIG. 4C is reached, the meshing point reaches the point K7 (corresponding to a position at the rotation angle D3), so that the inside pressure of the trap region becomes substantially equal to the inside pressure of the inlet chamber 5 (corresponding to P2 in FIG. 5). At this time, the communication state is switched to the third state, whereby the trap region 50 is opened to the inlet chamber 5 (see FIG. 5). When the meshing point reaches the point K7, the trap region 50 is brought into communication with the relief channel 25 thereby to communicate with the inlet chamber 5.

When the meshing point on the side of the inlet chamber moves from the point K7 to the point K8 (corresponding to a position at the rotation angle D4) as shown in FIG. 4C, the meshing point on the side of the outlet chamber reaches the point K3. During the movement of the meshing point from the point K7 to the point K8, the trap region 50 communicates only with the relief channel 25, and the communication between the trap region and the outlet chamber 6 is blocked by the meshing point on the side of the outlet chamber (in the third state).

As the meshing further progresses, the communication between the outlet chamber 6 and the inlet chamber 5 is blocked by the single meshing point as described above. Thereafter, the communication state is sequentially switched among the first, second and third states to cause the gear meshing to progress.

In accordance with this embodiment, the provision of the low pressure side relief channel 25 allows the trap region 50 to have an inside pressure substantially equal to the inside pressure of the inlet chamber 5 for releasing the inside pressure of the trap region 50 into the inlet chamber 5. Therefore, no impact is developed at the pressure release, so that the noises and the vibrations can be prevented.

Since the high pressure side relief channel 26 is located in the position that allows for the switching of the communication state from the first state to the second state when the volume of the trap region 50 is minimized, an increase in the volume of the trap region 50 can be enhanced in the second state. As a result, a reduction in the inside pressure of the trap region can be enhanced in the second state. Therefore, the inside pressure of the trap region can sufficiently be reduced to be made closer to the inside pressure of the inlet chamber 5, so that the noises and the vibrations can assuredly be prevented.

Since the communication between the relief channel 26 and the trap region 50 is blocked when the volume of the trap region 50 is minimized, the amount of the operating fluid returning to the inlet chamber 5 from the outlet chamber 6 via the gear meshing position can be minimized.

The configuration of the edges of the respective relief channels 25, 26 is not limited to the linear configuration, but may be of a bent configuration, e.g., M-shape. Further, it is merely necessary that the respective relief channels 25, 26 are formed in at least one of the side plates 12.

Various modifications may be made without departing the spirit and scope of the present invention.

What is claimed is:

1. A gear pump which includes a pair of gears accommodated in a gear chamber and has a trap region developed in the vicinity of a meshing position of the pair of gears during rotation of the pair of gears, the gear pump comprising:

an operating fluid inlet chamber and an operating fluid outlet chamber disposed on opposite sides of the meshing position within the gear chamber;

a first relief channel for providing communication between the trap region and the outlet chamber; and a second relief channel for providing communication between the trap region and the inlet chamber, wherein, as the pair of gears are rotated, a communication state is sequentially switched among a first state in which the trap region communicates only with the first relief channel, a second state in which communication between the trap region and the first and second relief channels is blocked, and a third state in which the trap region communicates only with the second relief channel, wherein the communication state is switched to the third state when the inside pressure of the trap region is reduced to a level substantially equal to the inside pressure of the inlet chamber in the second state during the rotation of the pair of gears.

2. A gear pump as set forth in claim 1, wherein the communication state is switched to the second state when the volume of the trap region is minimized in the first state during the rotation of the pair of gears.

3. A gear pump as set forth in claim 1, wherein the second relief channel is brought into communication with the trap region to switch the communication state from the second state to the third state when the inside pressure of the trap region is reduced to the level substantially equal to the inside pressure of the inlet chamber during the rotation of the pair of gears.

4. A gear pump as set forth in claim 1, wherein the communication between the first relief channel and the trap region is blocked when the volume of the trap region is minimized during the rotation of the pair of gears.

5. A gear pump as set forth in claim 1, further comprising:

a housing having a cavity therein; and a pair of side plates fitted in the cavity and defining the gear chamber in the housing, wherein the first and second relief channels are provided in a side face of at least one of the side plates opposed to the gears.

* * * * *